US009683386B1

(12) United States Patent
Morrison

(10) Patent No.: US 9,683,386 B1
(45) Date of Patent: Jun. 20, 2017

(54) PORTABLE SHELTER

(71) Applicant: Larry B. Morrison, Pasadena, CA (US)

(72) Inventor: Larry B. Morrison, Pasadena, CA (US)

( * ) Notice: Subject to any disclaimer, the term of this patent is extended or adjusted under 35 U.S.C. 154(b) by 0 days.

(21) Appl. No.: 15/088,651

(22) Filed: Apr. 1, 2016

(51) Int. Cl.
*E04H 15/46* (2006.01)
*E04H 15/54* (2006.01)
*E04B 1/38* (2006.01)

(52) U.S. Cl.
CPC ..... *E04H 15/46* (2013.01); *E04B 1/38* (2013.01); *E04H 15/54* (2013.01)

(58) Field of Classification Search
CPC ..... E04H 15/34; E04H 15/54; E04H 15/18; E04H 15/46; E04H 15/60; E04H 15/16; E04B 1/38
USPC ..... 135/121–122, 141, 157–158, 114, 135/117–119; 52/79.1, 79.6, 79.9, 126.1, 52/126.6, 588.1, 580, 632, 639; 446/476, 446/478, 479, 105
See application file for complete search history.

(56) References Cited

U.S. PATENT DOCUMENTS 1,792,669 A * 2/1931 Wickstrum ..... E04H 15/32 135/119
2,036,033 A 3/1936 Fisher
D176,504 S 1/1956 Daus
3,242,620 A 3/1966 Kaiser
3,571,965 A * 3/1971 Gibb ..... A63H 33/105 446/105
3,870,061 A 3/1975 Lowery
4,041,659 A * 8/1977 McElhoe ..... E04B 1/24 52/639
4,141,526 A * 2/1979 John ..... B66F 3/08 248/352
4,346,725 A * 8/1982 Shaw ..... B62J 17/08 135/96
4,586,300 A * 5/1986 Mullin ..... E04B 1/24 403/189
4,605,030 A 8/1986 Johnson
4,683,901 A 8/1987 Mitchell
4,834,128 A 5/1989 Burgess
4,944,321 A 7/1990 Moyet-Ortiz
4,989,826 A * 2/1991 Johnston, Jr. ..... F16M 5/00 248/237
4,991,363 A 2/1991 Randmae
5,241,977 A 9/1993 Flores
5,573,026 A 11/1996 Griffith
5,579,610 A 12/1996 Jackson
(Continued)

*Primary Examiner* — Winnie Yip
(74) *Attorney, Agent, or Firm* — Brooks Kushman P.C.

(57) ABSTRACT

A portable and adjustable shelter for sheltering vehicles, cars, or goods or people is disclosed. The shelter includes a plurality of legs, each leg having a column base attached to a first column which is attached to a second column. The first column is vertically adjustable relative to the column base, enabling the height of the legs to be adjusted. The second column has a projection for attaching to a roof. The roof has a pair of truss assemblies each configured to attach two legs, and each having an upper surface and a lower surface. The lower surface defines a plurality of spaced apart receptacles sized to receive the projection of the second column to secure the roof to the legs at various positions, enabling the user to alter the width of the shelter.

20 Claims, 11 Drawing Sheets

(56) References Cited

U.S. PATENT DOCUMENTS

| | | | | |
|---|---|---|---|---|
| 5,579,796 | A | 12/1996 | Mallo | |
| D383,218 | S | 9/1997 | Jefferson | |
| 5,746,237 | A | 5/1998 | Arnic | |
| 5,966,890 | A * | 10/1999 | Inman | E04B 1/24 52/643 |
| 6,257,263 | B1 | 7/2001 | Brereton | |
| 6,619,610 | B1 * | 9/2003 | Genovese | E04H 12/2246 135/118 |
| 6,964,446 | B2 | 11/2005 | Porter | |
| 7,296,584 | B2 * | 11/2007 | Goldwitz | E04H 15/44 135/121 |
| 7,546,844 | B2 | 6/2009 | Al-Mutairi | |
| 7,877,936 | B2 * | 2/2011 | Uffner et al. | E04B 7/20 52/588.1 |
| 7,913,710 | B2 | 3/2011 | Bougioukos | |
| 8,001,987 | B2 | 8/2011 | Williams | |
| 8,336,568 | B1 | 12/2012 | Belden | |
| 8,539,734 | B2 | 9/2013 | Heisler | |
| 8,573,417 | B1 * | 11/2013 | Anderson | D06F 53/045 211/119.01 |
| 8,607,810 | B1 | 12/2013 | Chung | |
| 2011/0094569 | A1 * | 4/2011 | Hartley et al. | E04H 6/025 136/251 |

* cited by examiner 62
60
C
C
62

62
64A
60
62

60
64A

1

1

1

1

1

1

PORTABLE SHELTER

TECHNICAL FIELD

The present disclosure relates to a portable shelter. More specifically, the present disclosure relates to an assembly that is readily customizable in size in order to shelter objects such as vehicles, people, or goods, for a short or an extended period of time.

SUMMARY

According to one embodiment, a portable and adjustable shelter includes a plurality of legs. Each leg has a column base defining a lower surface for contacting an underlying surface, and an upper surface defining a cavity with a first surface feature therein. Each leg also has a first column with a second surface feature configured to engage with the first surface feature within the cavity, wherein the second surface feature is adjustable relative to the first surface feature enabling the first column to be vertically adjusted relative to the column base. Each leg also has a second column configured to attach coaxially with the first column, the second column having a projection extending therefrom. The shelter further includes a roof attached to the plurality of legs, the roof having a pair of truss assemblies configured to connect two of the legs, each truss assembly having an upper surface and a lower surface, the lower surface of each truss assembly defining a plurality of spaced apart receptacles sized to receive the projection of the second column to secure the roof to the legs at various positions.

According to another embodiment, a portable and adjustable shelter includes a plurality of legs adjustable in height, wherein a portion of the legs define a hollow cavity covered by a plug to enable storage of a substance therein to add weight to the legs, the legs each having a projection at one end. A pair of truss assemblies each connect two of the legs along a length of the shelter, and each truss assembly has a plurality of receptacles facing the legs and configured to receive the projection enabling the legs to connect to the truss assemblies at various distances apart. The truss assemblies have a plurality of notches formed therein. A plurality of beam body members each connect to both truss assemblies within two of the notches. A fabric covers the beam body members and at least a portion of the truss assemblies.

DETAILED DESCRIPTION

Embodiments of the present disclosure are described herein. It is to be understood, however, that the disclosed embodiments are examples and that other embodiments can take various and alternative forms. The figures are not necessarily to scale; some features may be exaggerated or minimized to show details of particular components. Therefore, specific structural and functional details disclosed herein are not to be interpreted as limiting, but rather as a representative basis for teaching one skilled in the art to variously employ the embodiments. As those of ordinary skill in the art will understand, various features illustrated and described with reference to any one of the figures can be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

References to "width" and "length" are made below. These words are used for context only, relative to the orientation illustrated in FIG. 1, in which a generally rectangular structure is shown with one side being a "length" and another shorter side being a "width." Multiple individual structures can be attached side-by-side along their length sides, as will be described with reference to FIGS. 14-15, which increases the overall "width" of the structure.

Figure 1:
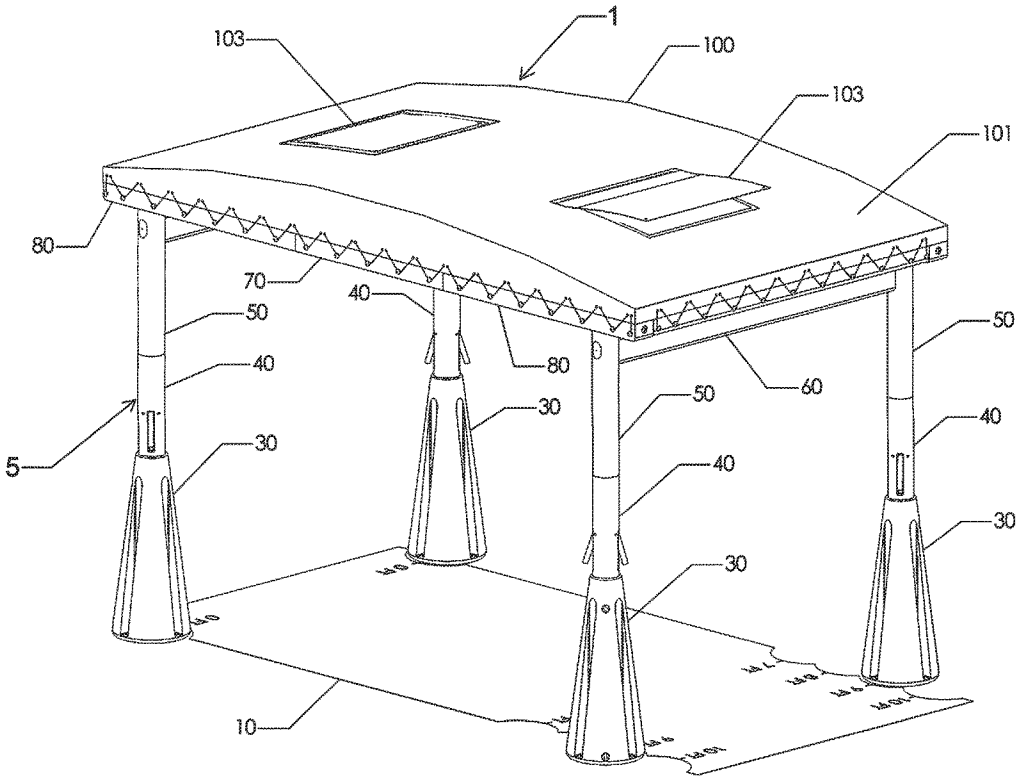
FIG. 1 is a perspective view of a portable shelter according to one embodiment of this disclosure.

Referring to FIG. 1, a portable shelter 1 is illustrated according to one embodiment. As will be described below, the portable shelter 1 is a customizable and modular structure configured to shield various sized objects from the environment. The portable shelter shown in FIG. 1 is a single-module embodiment in which four legs 5 at four respective corners hold a roof above the underlying surface. This single-module portable shelter can vary in height or width to accommodate the size of the objects being shielded. In other embodiments described below, the portable shelter can also be attached with other modules, and other multiple-module length embodiments to create multiple-module embodiments.

FIG. 1 shows many of the main components of the portable shelter that are shown individually in subsequent figures. The portable shelter rests on a placement pattern assembly or template 10 that will be described in further detail with reference to FIG. 2 below. Each leg 5 or column includes an individual attachment rod 20 (FIGS. 3C, 3F), a column base 30, a lower column 40, and an upper column 50. Along the width of the portable shelter, a column beam 60 connects two of the legs. Along the length of the portable shelter, a truss assembly that includes a middle truss body 70 and a pair of end truss bodies 80 connects two of the legs. The truss includes a middle truss body 70 connected to and flanked by a pair of end truss bodies 80. Roof beam body members 90 (FIG. 9) extend parallel to the column beam 60 at spaced intervals along the length of the portable shelter. These roof beam body members 90 are support members for an overlying roof cover 100.

In some embodiments, the components shown in FIG. 1 are created through rotational molding or injection molding, although thermal molding or other fabrication techniques can be used. The components can be made of plastic, such as polypropylene. In one embodiment, the components such as the column bases 30, lower columns 40, and upper columns 50 are made of a thermoplastic polymer, such as acrylonitrile butadiene styrene. The components typically will have a wall thickness of approximately 0.125 to 0.1875 inches. In other embodiments, the components are not made from plastic, but rather from fiberglass or metal.

Each of the main components of FIG. 1 is described in more detail below. These main components are also shown in isolation in various figures.

The portable shelter 1 can be positioned on the ground according to its relationship to the placement pattern 10. The placement pattern has cut-outs on its sides for different locations to match with the legs 5 of the shelter 1, providing the user with a template for how far to space the legs. The placement pattern 10 has a pair of cut-outs marked "0 feet" at slot aligners for placing two of the column bases 30. The placement pattern 10 has a plurality of additional cut-outs marked "7 feet," "8 feet," "9 feet," and "10 feet" at respective pairs of aligners formed therein. These aligners guide a user in aligning two more of the column bases 30 for a desired length of the portable shelter 1.

Figure 2:
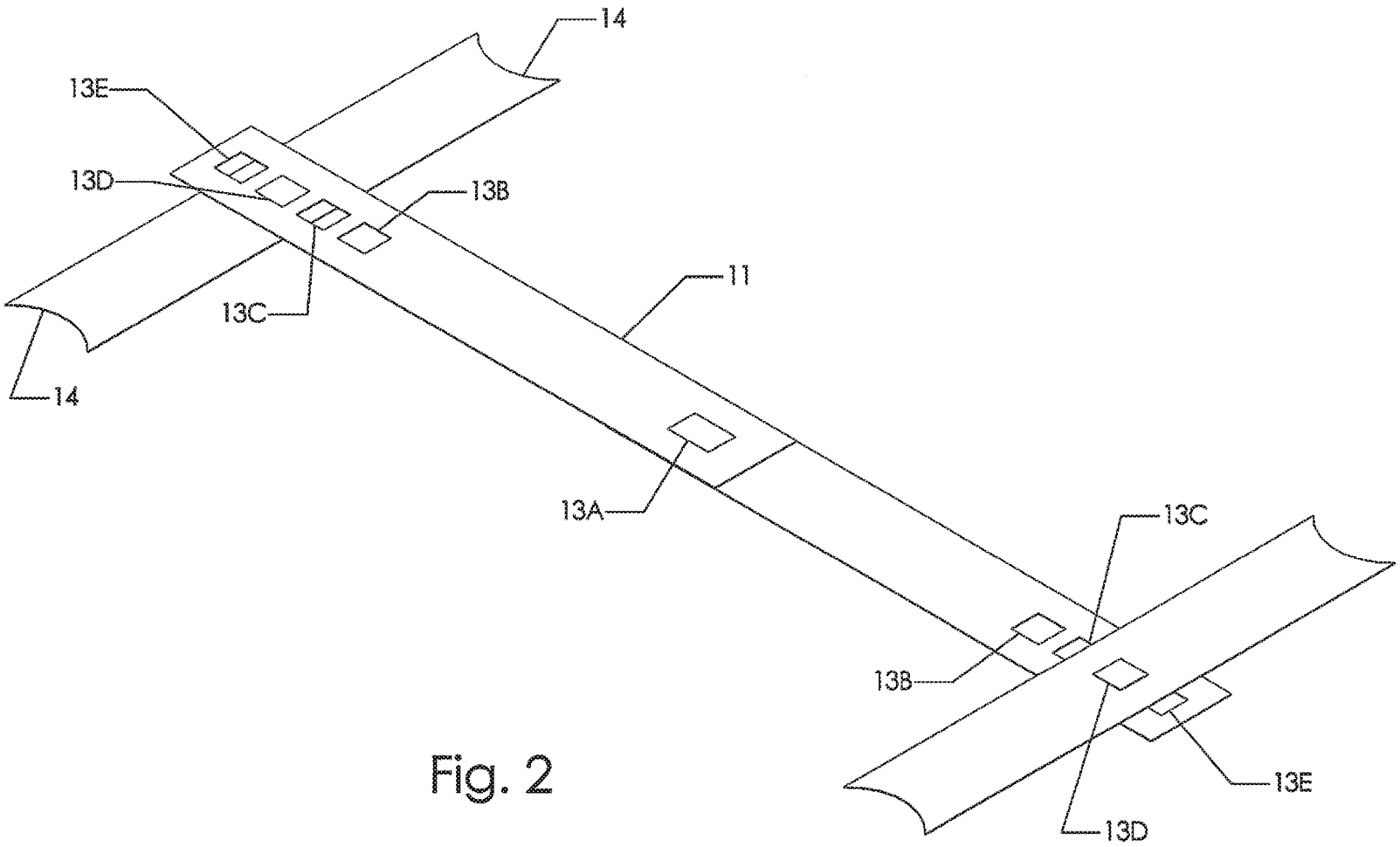
FIG. 2 is a perspective view of a placement template for aiding a user in locating components of the portable enclosure for proper alignment and sizing, according to one embodiment.

Referring to FIG. 2, another embodiment of aligners is shown. The aligners have a pair of surface features 14 that are sized according to the size of the bottom of the column base 30. A user can place a column base 30 against the surface features. A pair of aligners are spaced apart by a spacer 11. The spacer 11 has a central fastening feature 13A to fasten two parts of the spacer 11 together. The spacer 11 also has a plurality of plurality of additional surface features, such as openings 13B, 13C, 13D, and 13E. These openings are configured to receive a corresponding projection extending from the aligners such that the user can select a desired length of the shelter 1. For example, if the user wishes to have a length of seven feet (the shortest available length in this embodiment), the holes 13B can engage with the projection in the aligner to create a seven-foot length between the pairs of legs 5 to define the length of the shelter 1.

Figures 3A, 3B, 3C, 3D, 3E, 3F, 3G, 3H:
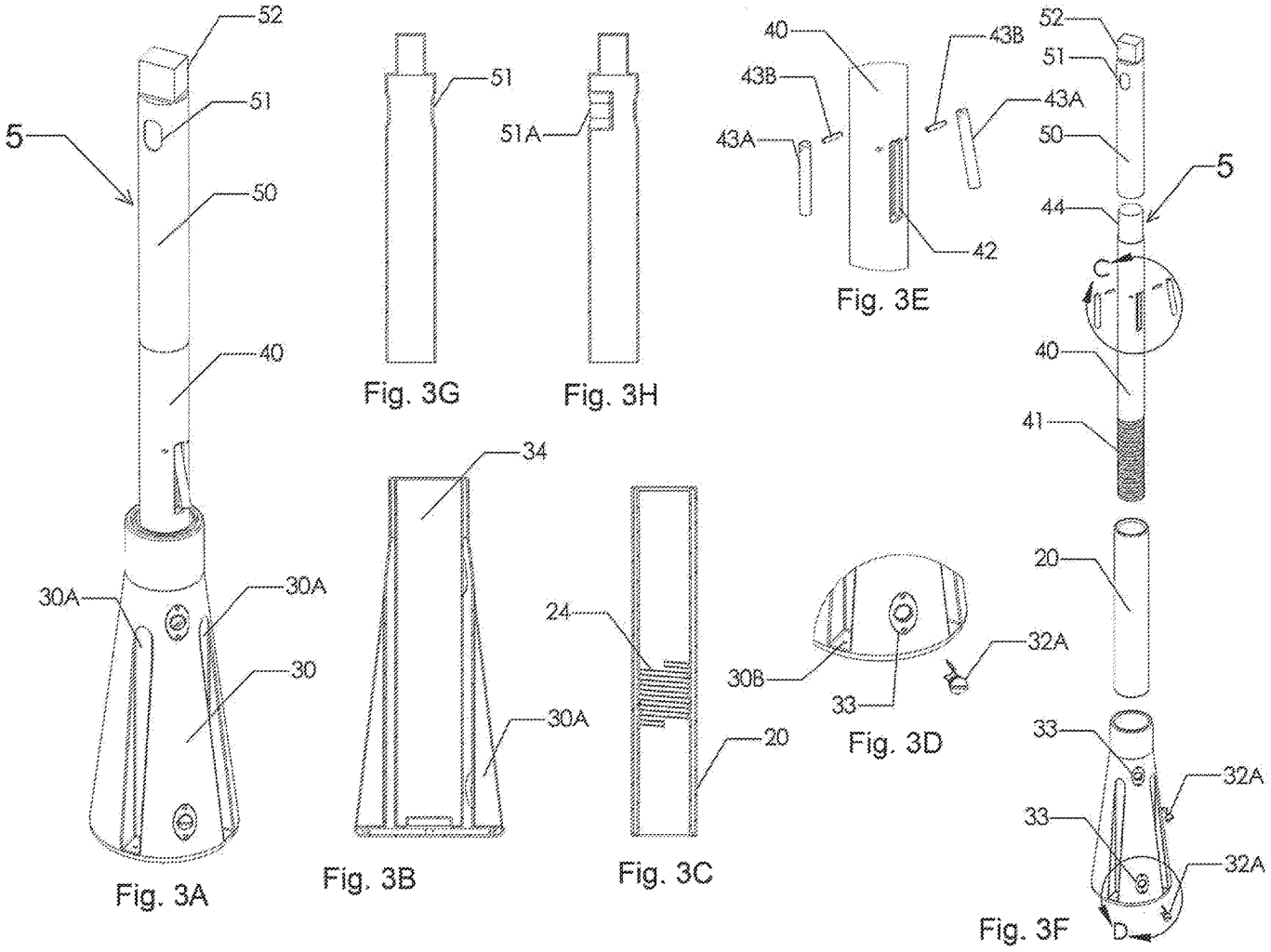
FIG. 3A is a perspective view of one of the legs of the portable shelter, according to one embodiment.
FIG. 3B is a cross-sectional view of a column base of one of the legs, according to one embodiment.
FIG. 3C is a cross-sectional view of an attachment rod configured to be housed within the column base of one of the legs, according to one embodiment.
FIG. 3D is a perspective view taken along line D of FIG. 3F.
FIG. 3E is an exploded perspective view of an upper portion of a lower column of the leg within line C of FIG. 3F, according to one embodiment.
FIG. 3F, is an exploded perspective view of the leg of FIG. 3A, according to one embodiment.
FIG. 3G is a side view of an upper column of the leg, according to one embodiment in which the upper column has a beam hole extending therethrough.
FIG. 3H is a side view of an upper column of the leg, according to an alternative embodiment in which the upper column has a beam hole that extends only partially therethrough.

FIG. 3A shows a perspective view of one of the legs 5 in an assembled state, and FIGS. 3B-3F show the various components of the leg 5. Each leg 5 includes a column base 30 which tapers inward in a direction away from the underlying surface. The tapered outer surface of the column base 30 defines a plurality of slots 30A extending at least partially through the thickness of the column base 30. The slots 30A are formed such that they have a flat vertical surface traveling generally up and down, in the direction of the height of the structure. This vertical flat surface provides a nesting region for the curtains that will be described below, as well as any signs, boards, or other structural pieces that may be desired to stretch across the length or width of the structure between two of the legs 5.

Referring to FIGS. 3B and 3C, a generally cylindrical opening 34 is defined within the column base 30. The opening 34 can include either male or female threading about the circumference of the cylinder. The opening 34 is sized and configured to receive the attachment rod 20 for attaching the lower column 40 to the column base 30. The attachment rod 20 is also generally cylindrical and has an outer diameter slightly smaller than the inner diameter of the cylindrical opening 34. The attachment rod 20 can have a hollow interior with an inner surface that defines either male or female threading 24. The threading 24 can engage with corresponding threading 41 of the lower column 40, discussed further below. In one embodiment not shown, one or more flanges can extend from the outer surface of the attachment rod 20 at a lower region thereof. The flange can be sized and configured to engage with a corresponding cavity or pocket at the bottom of the column base 30. This allows the bottom of the attachment rod 20 to be coplanar with the bottom of the column base 30 while both rest on the underlying surface.

Referring to FIG. 3D, the column base 30 defines an indent 30B located within the slot 30A. The indent 30B is sized and configured to receive an anchoring feature for anchoring the curtain (which is described below) or other board or structural member that fits within the groove 30A. A filler cap 32A or plug is sized and configured to be received within a corresponding hole 33 that is formed within the column base 30. The filler cap 32A can be removed or otherwise disengaged from the column base, exposing the hole 33. This allows the user to fill the interior of the column base 30 with water, sand, or other substance. The user can then plug the hole 33 with the filler cap 32A, entrapping the substance within the column base 30. The column base 30, when filled with the substance, can weigh the entire structure 1 down to inhibit movement of the structure due to wind, etc. To make the structure portable again, the user can drain or otherwise remove the substance from the hole 33. The filler cap 32A can include a step with a flange that is larger than the hole 33 and disposed within the interior of the column base 30 such that the filler cap 32A, when unplugged from the hole 33, can still remain attached to the column base 30.

Figure 3I:
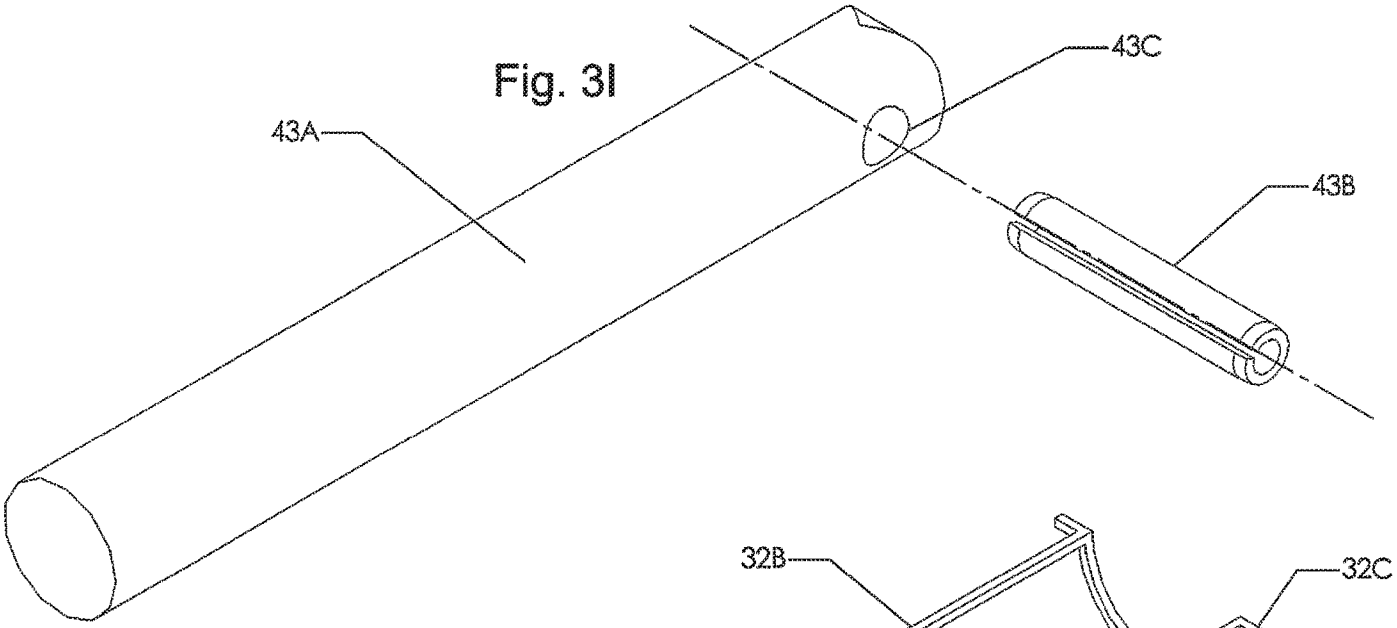
FIG. 3I is an exploded perspective view of a handle that can be rotatably attached to a lower column of the leg via a pin, according to one embodiment.
Figure 3J:
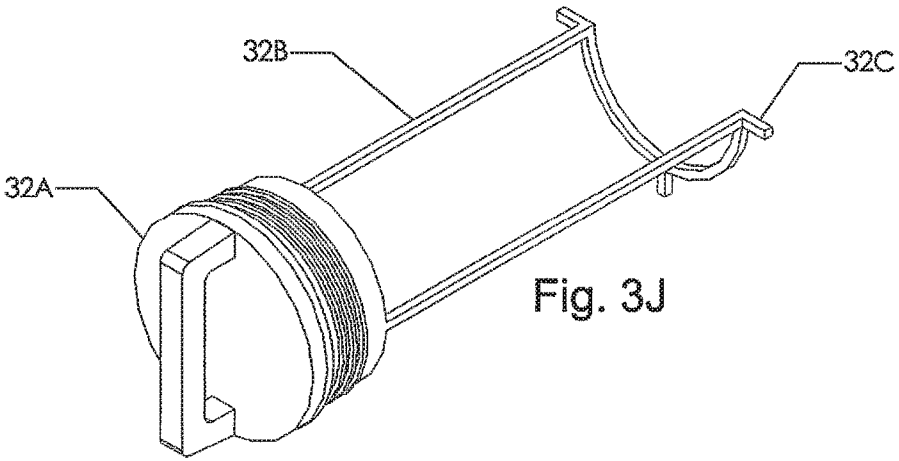
FIG. 3J is a perspective view of a plug insertable into a hole in a lower region of the leg, according to one embodiment.

The filler cap 32A is shown in perspective in FIG. 3J. The filler cap 32A has a threaded or ribbed head to engage with corresponding surface features within the hole 33. A set of wires 32B extend longitudinally from the head, and end at an end region 32C. The end region of the wire at 32C is wider than the diameter of the hole 33 such that the wire can be retained within the hole 33 even when the filler cap 32A is removed. In one embodiment, the wire is plastic.

Referring to FIGS. 3E and 3F, additional detail of a portion of the lower column 40 is shown. The lower column 40 includes threading 41 to engage with the threading 24 of the attachment rod 20. In this fashion, the lower column 40 can slide into the interior of the attachment rod 20 within the column base 30 and screw or fasten with the attachment rod. The lower column 40 is secured to the attachment rod 20 via a threading engagement at 24 and 41.

The lower column 40 also includes a pair of opposing handle recesses 42. A pair of handles 43A can be rotatably attached to the lower column 40 via a pin 43B, and can be stored within the handle recess 42 flush with the lower column. This allows the user to pull the handles 43A away from the lower column and grasp the handles 43A while turning the lower column 40 relative to the attachment rod 20 to screw and unscrew the lower column 40 to the attachment rod 20.

The lower column 40 also includes a projection 44 extending coaxial from the lower column 40. The projection 44 is sized with a slightly smaller diameter than that of the lower column 40. The projection is configured to fit within a recess or pocket on the bottom side of the upper column 50. The upper column 50 slides over the lower column 40 via the projection 44. The upper column 50 also defines a beam hole 51 sized to receive the column beam 60 that extends between and connects two of the legs 5. The upper column 50 also has a connector 52 extending therefrom that is sized to be received within a receptacle 85 of an end truss body 80, as will be described below.

In another embodiment, the beam hole 51 only extends partially (e.g., halfway) through the upper column 50 for a certain number of legs 5. This is shown in FIG. 3H, in which the beam hole 51 is filled at one end, as indicated by surface 51A. If the entire structure is multiple sets of legs long (like in FIG. 14), the legs 5 that are on the outermost corners can have the beam holes 51 only extend partially therethrough, facing the interior of the structure.

FIG. 3F shows an exploded perspective view of the components that make up each leg 5. In short, the attachment rod 20 is placed within and engages the column base 30, which can be filled with water, sand, etc. The lower column 40 screws to the column base, and the handles 43A can assist in doing so. The upper column 50 can then attach to the lower column 40 via the projection 44.

FIG. 3I shows the handles 43A in perspective, with the associated pin 43B. In assembly, the pin 43B extends through a corresponding hole 43C in the handle 43A to rotatably connect the handle 43A to the lower column 40.

Figures 4A, 4B, 4C:
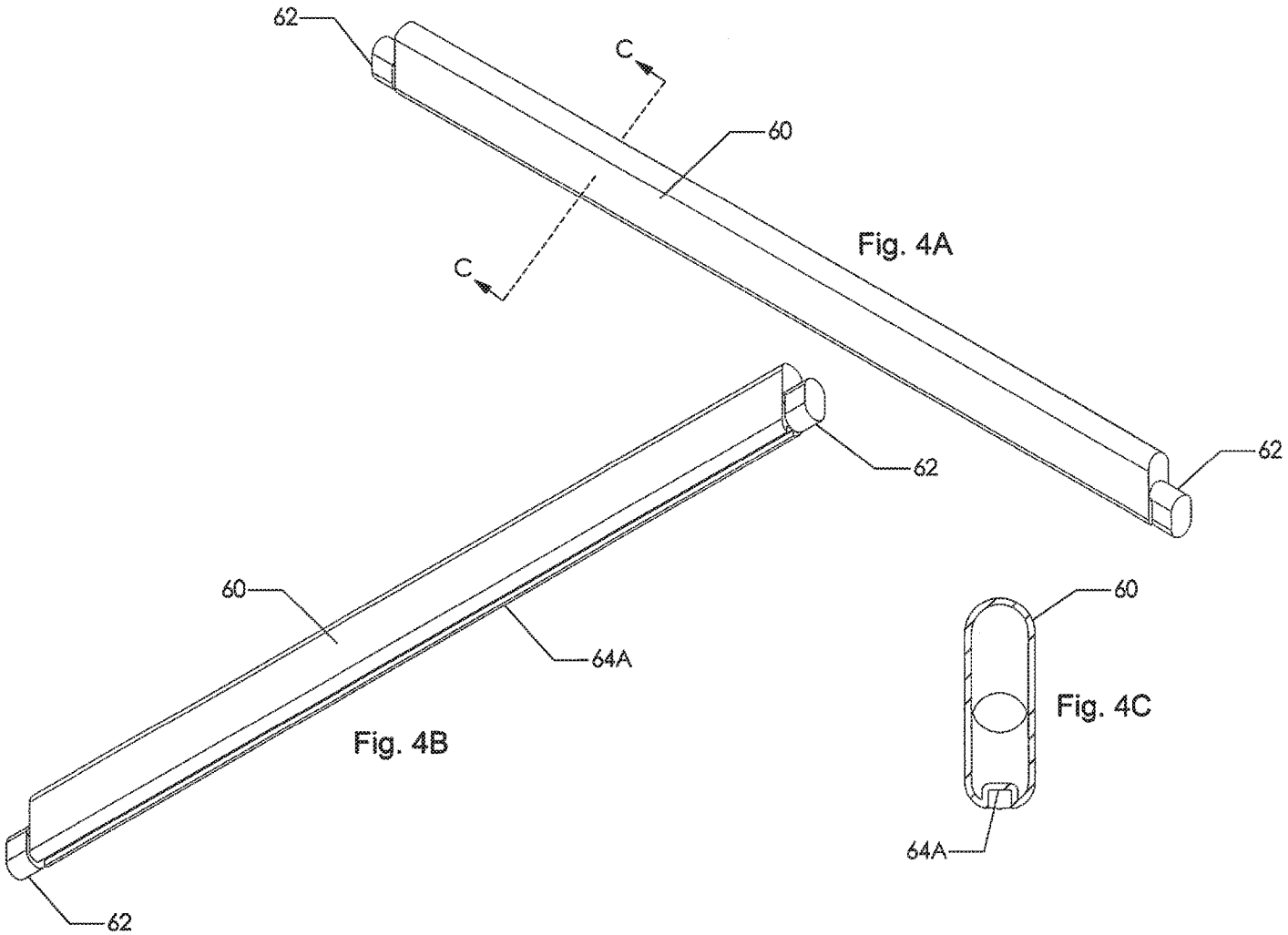
FIG. 4A is a top perspective view of a column beam configured to attach to a pair of legs along a width of the portable structure, according to one embodiment.
FIG. 4B is a bottom perspective view of the column beam of FIG. 4A.
FIG. 4C is a cross-sectional view of the column beam taken along line C-C of FIG. 4A.

FIGS. 4A and 4B show various perspective views of the column beam 60. The column beam 60 connects two legs 5 along the width of the portable structure 1, as shown in FIG. 1. To do so, the column beam 60 includes a pair of notches 62 extending from opposing end surfaces of the column beam 60. The notches 62 are sized to be received in the corresponding beam holes 51 of the upper column 50.

Figure 13B:
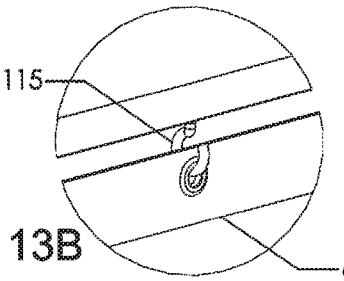
FIG. 13B is a partial perspective view of a hook connecting the curtain to the column beam, taken along line A of FIG. 13A, according to one embodiment.

FIG. 4C is a cross-sectional view taken along line C-C of FIG. 4A. As shown in FIGS. 4B and 4C, the underside of the column beam 60 includes a longitudinal groove 64A formed therein. The groove 64A is configured to act as a guide for curtains or other such covers that can connect to the column beam 60 and cover the space between the two connected legs 5, as is shown in FIG. 13B described below.

Figure 5:
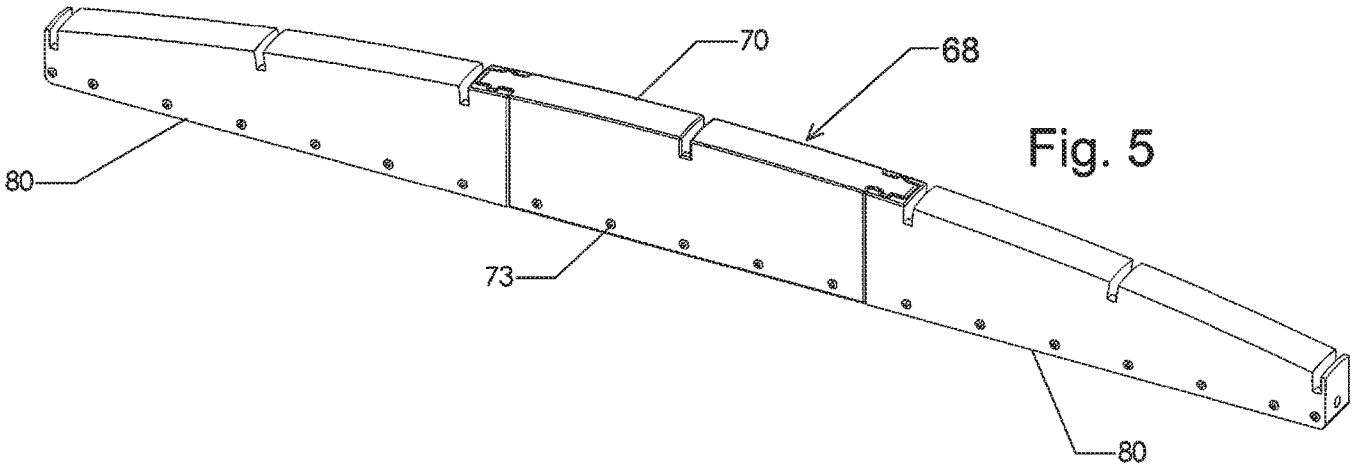
FIG. 5 is a perspective view of a truss assembly configured to attach a pair of legs along a length of the portable structure, according to one embodiment.

FIG. 5 illustrates a truss assembly 68 that includes a middle truss body 70 and a pair of end truss bodies 80 on either side of the middle truss body 70. It should be understood that more or less bodies can be used rather than the three bodies shown in FIG. 5. The assembled truss assembly 68 connects two legs 5 along the width of the portable structure 1.

Figure 6A:
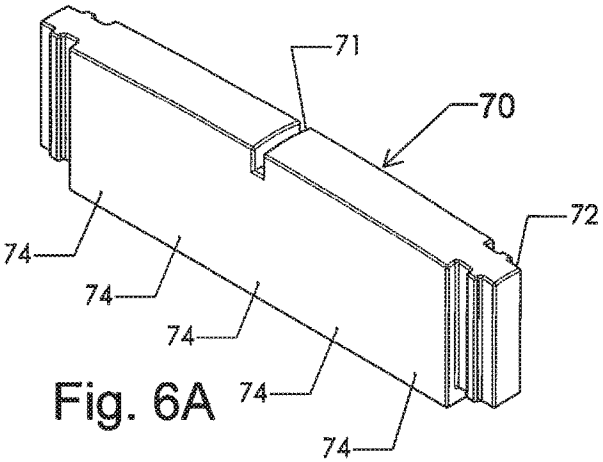
FIG. 6A is a top perspective view of a middle truss body of the truss assembly, according to one embodiment.
Figure 6B:
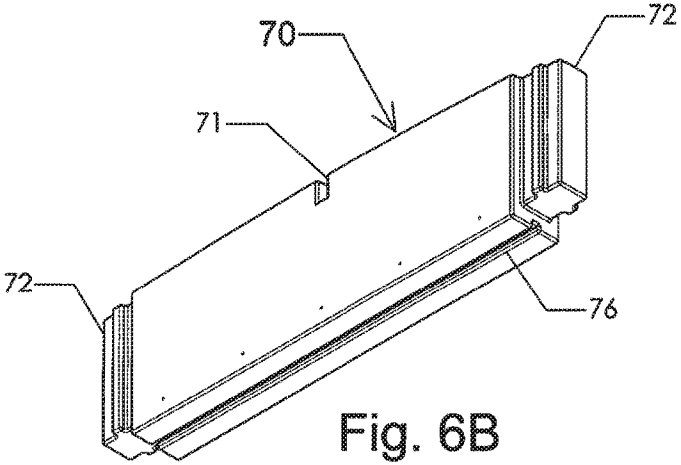
FIG. 6B is a bottom perspective view of the middle truss body of FIG. 6A.

FIGS. 6A and 6B illustrate perspective views of the middle truss body 70. The middle truss body has one or more notches 71 formed therein on the upper side of the body 70 to receive roof beam bodies 90, as described below. On either side of the middle truss body 70 is a projection 72 which is configured to slide within and be received by a corresponding slot or guide 82 formed in the side of the end truss body 80.

The middle truss body 70 also includes a plurality of apertures 74 formed therein. The apertures 74 do not need to pass entirely through the body 70, but must be at least deep enough to properly receive an anchor 73 (described below). The apertures 74 can includes screw threads to engage with corresponding screw threads of the anchor 73. In an alternative embodiment, dimples are provided instead of apertures, and the anchors can screw into the dimples themselves to create apertures during screwing.

The underside of the middle truss body 70 also includes a longitudinally extending groove 76 for attaching a curtain or other type of wall structure, similar to the groove 64A of the column beam 60.

Figures 7A, 7B, 8:
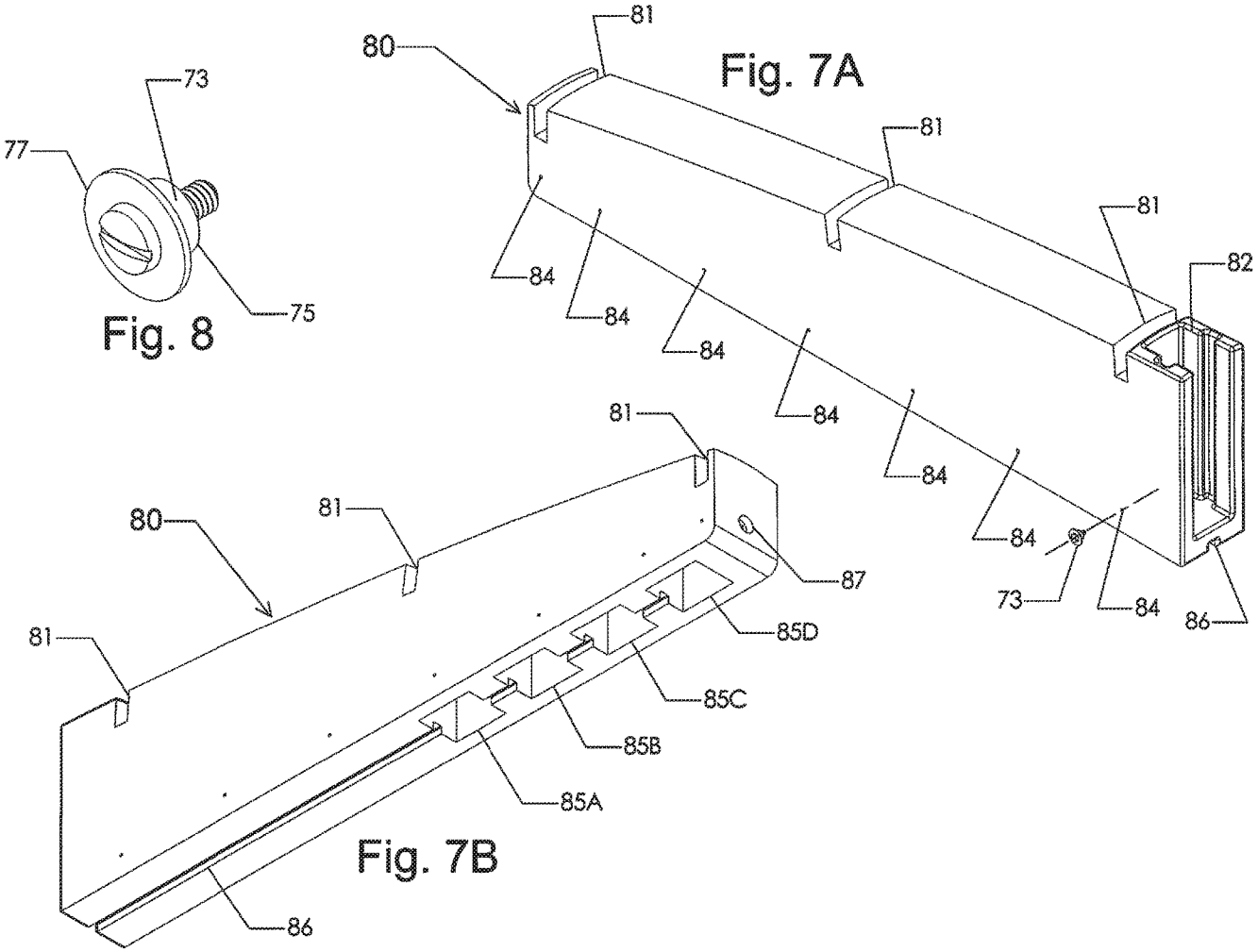
FIG. 7A is a top perspective view of an end truss body of the truss assembly, according to one embodiment.
FIG. 7B is a bottom perspective view of the end truss body of FIG. 7A.
FIG. 8 is a perspective view of an anchor for securing a roof cover to the truss assembly and the column beam, according to one embodiment.

FIGS. 7A and 7B illustrate perspective views of one of the end truss bodies 80. Similar to the middle truss body 70, the end truss body 80 includes one or more notches 81 to receive the roof beam bodies 90. One end of the end truss body 80 also includes the guide 82 formed therein to receive the projection 72.

Similar to the middle truss body 70, the end truss body also has a plurality of apertures 84, each configured to receive one of the anchors, like the apertures 74.

Also similar to the middle truss body 70, the underside of the end truss body includes a longitudinally extending groove 86 formed therein for attaching a curtain or other type of wall structure. Also on the underside are a plurality of receptacles 85A, 85B, 85C, and 85D at spaced apart locations along the length of the body 80. These receptacles 85A-85D are sized and configured to receive the connector 52 of the upper column 50. The spaced-apart nature of the receptacles provides the user with the ability to customize how far inset the legs 5 should be positioned with respect to the outer boundaries of the truss assembly 68 and roof. In other words, the distance between the legs 5 can be customized along the length of the portable structure 1 while retaining the overall profile and size of the roof.

FIG. 8 illustrates the anchor 73 in a perspective view. The anchor 73 can include a screw for screwing into the apertures 74, 84. The anchor 73 has a boss 75 that has a diameter larger than the apertures 74, 84 such that the boss 75 does not secure with in the apertures 74, 84. The boss 75 provides separation between the outer surface of the truss assembly 68. The surface area on the boss 75 provides an attachment surface for a cord 106 that will be described below. A washer 77 or flange provides an end surface and defines the outer boundary of the boss 75 to keep the cord 106 between the washer 77 and the truss assembly 68.

Figure 9:
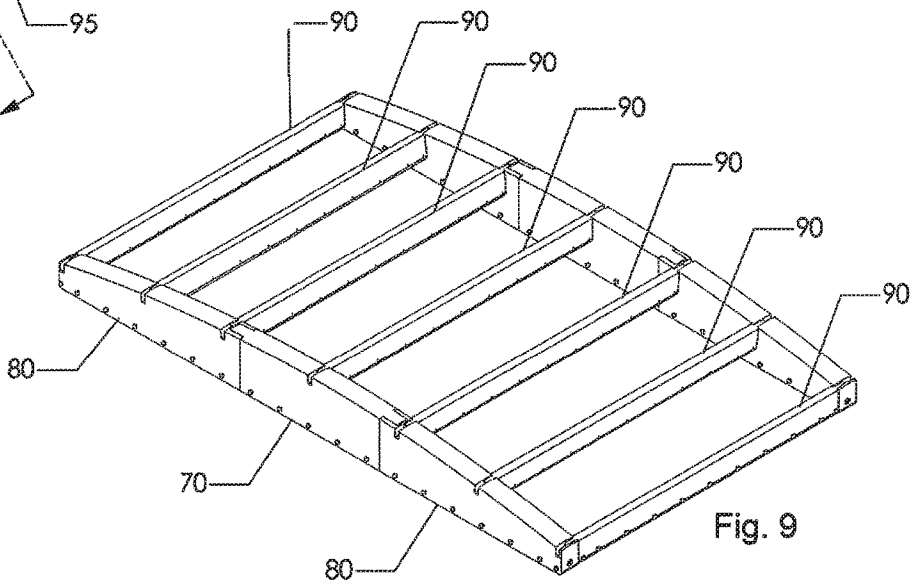
FIG. 9 is a perspective view of an assembled roof structure without a roof cover, with a plurality of roof beam bodies extending along the width of the portable structure, according to one embodiment.

FIG. 9 illustrates a pair of truss assemblies 68 with a plurality of roof beam bodies 90 extending there-between, in a direction of the width of the portable structure 1. Each roof beam body 90 secures within the notches 71 of the center middle truss body 70 or the notches 81 of the end truss bodies 80. The roof beam bodies 90 provide a secure connection between both truss assemblies 68, and also provide a support for a roof cover 100 to be placed over the assembly.

Figure 10B:
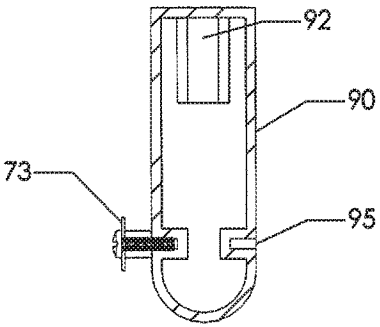
FIG. 10B is a cross-sectional view of the roof beam body, taken along line B-B of FIG. 9.
Figure 10A:
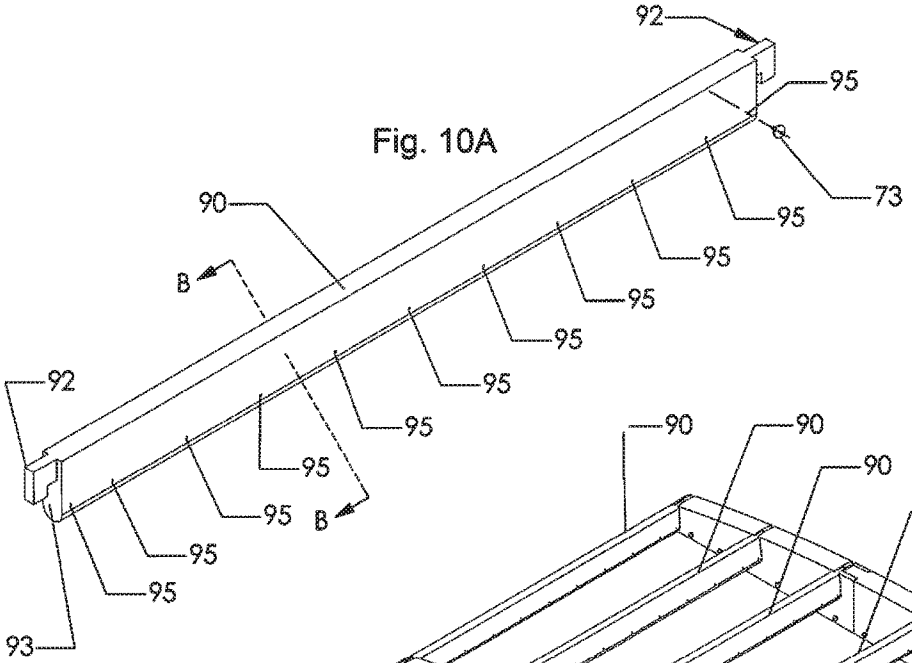
FIG. 10A is a top perspective view of one of the roof beam bodies of FIG. 9, according to one embodiment.

FIG. 10A shows a single roof beam body 90 in isolation, and FIG. 10B is a cross-sectional view of one roof beam body 90. The roof beam body 90 includes a pair of projections 92 that fit into the corresponding notches 71 or 81. Each projection has a space 93 between a part of the projection 92 and the roof beam body 90 to allow for clearance. A plurality of apertures 95 are provided for more of the anchors 73 to be attached, as described above. As shown in the embodiment of FIG. 10B, the apertures 95 do not extend all the way through the roof beam body 90. Also shown in FIG. 10B, a pair of opposing apertures 95 can be provided on opposing sides of the roof beam body 90 to allow anchors 73 to be attached on either side of the roof beam body 90.

Figures 11A, 11B, 12A, 12B:
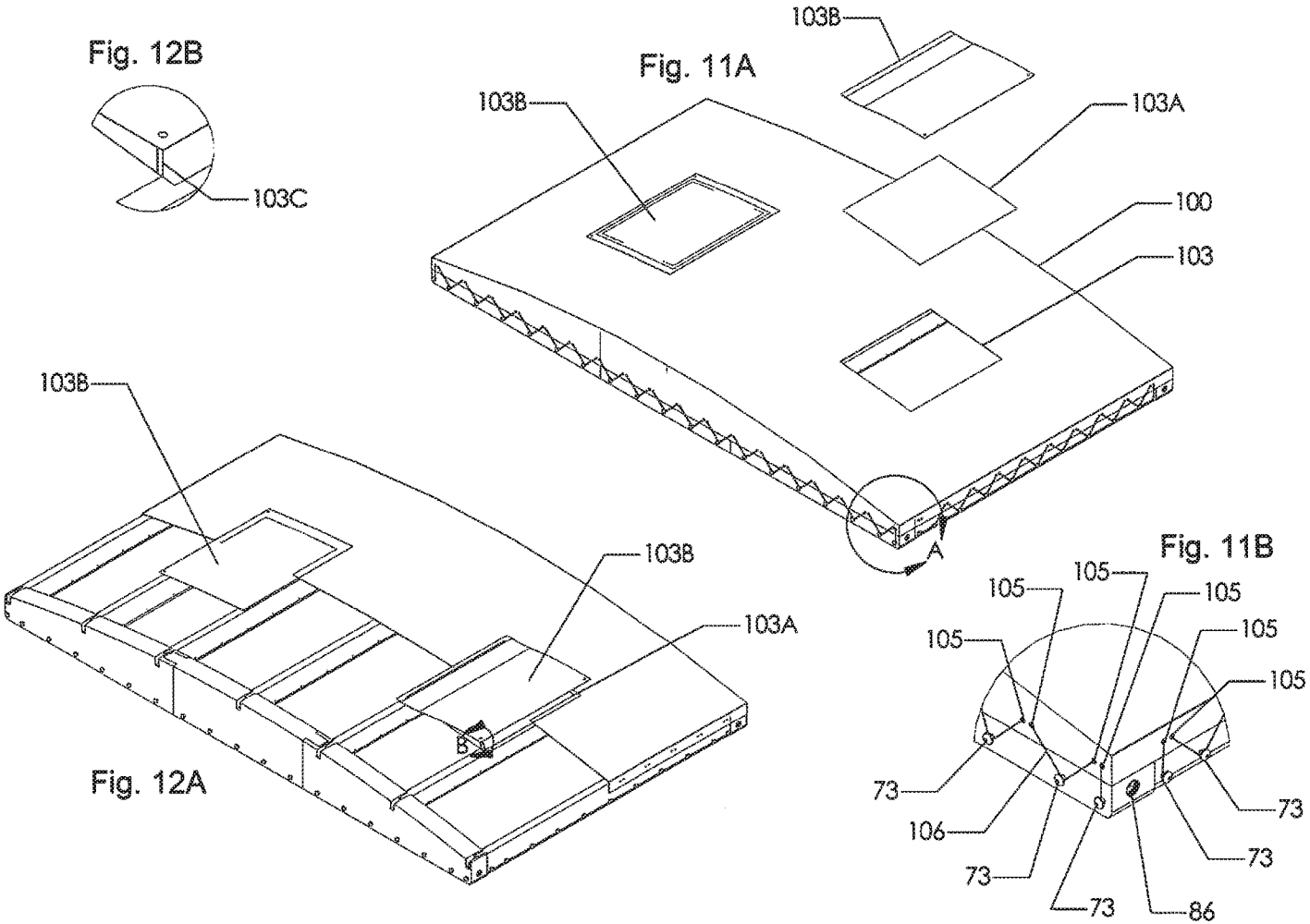
FIG. 11A is a perspective view of a roof cover configured to attach to the roof structure, according to one embodiment.
FIG. 11B is a partial perspective view of one corner of the roof cover, taken along line A of FIG. 11A.
FIG. 12A is a perspective view of the roof cover covering the roof structure, with part of the roof cover removed to show the underlying structure, according to one embodiment.
FIG. 12B is a partial perspective view of one corner of a vent in the roof, taken along line B of FIG. 12A, according to one embodiment.

FIG. 11A shows a roof cover 100 that can be placed over the connected roof beam bodies 90 and the truss assemblies 68. FIG. 11B shows a zoomed-in view of one of the corners of the roof cover 100 and its attachment to the truss assembly 68 and column beam 60. FIG. 12A shows a perspective view of the roof cover 100 with half of the roof cover 100 removed to show the underlying structure, and FIG. 12B shows a connection of a vent 103A and vent cover 103B above a vent hole 103.

Referring to FIGS. 11A-12B, the roof cover 100 can be made of a canvas fabric, or any other suitable fabric that is weather (e.g., rain, snow, etc.) resistant, but also flexible and bendable to give and move in response to wind. The roof cover 100 can include one or more vent holes 103, allowing air to pass through the roof cover 100. Each vent hole 103 can be covered by a vent 103A that is fixed (e.g., sewn, welded, attached) at one end of the vent hole 103 but not directly fixed at the other end. This allows the vent 103A with the ability to pivot with respect to the roof cover 100 to selectively "open" and "close." A vent cover 103B is also provided, being attached to the vent 103A via cords 103C. In one embodiment, the vent 103A is breathable to allow air to flow therethrough. In another embodiment, the vent is a solid material such as plastic or vinyl with less breathability, inhibiting or preventing air from flowing therethrough.

As previously described, a plurality of anchors 73 are affixed to the truss assembly 68 and column beams 60. The roof cover 100 is attachable to the truss assembly 68 and column beam 60 by a cord 106 that can be stretched to extend underneath the anchors 73. Metal or plastic grommets 105 surround corresponding apertures in the roof cover 100 where the cord 106 to extend through the roof cover 100. In one embodiment, a plurality of cords are used, each attached at both ends to the roof cover 100 at different locations. In another embodiment, a single cord is used about the entire roof cover 100.

Figure 13A:
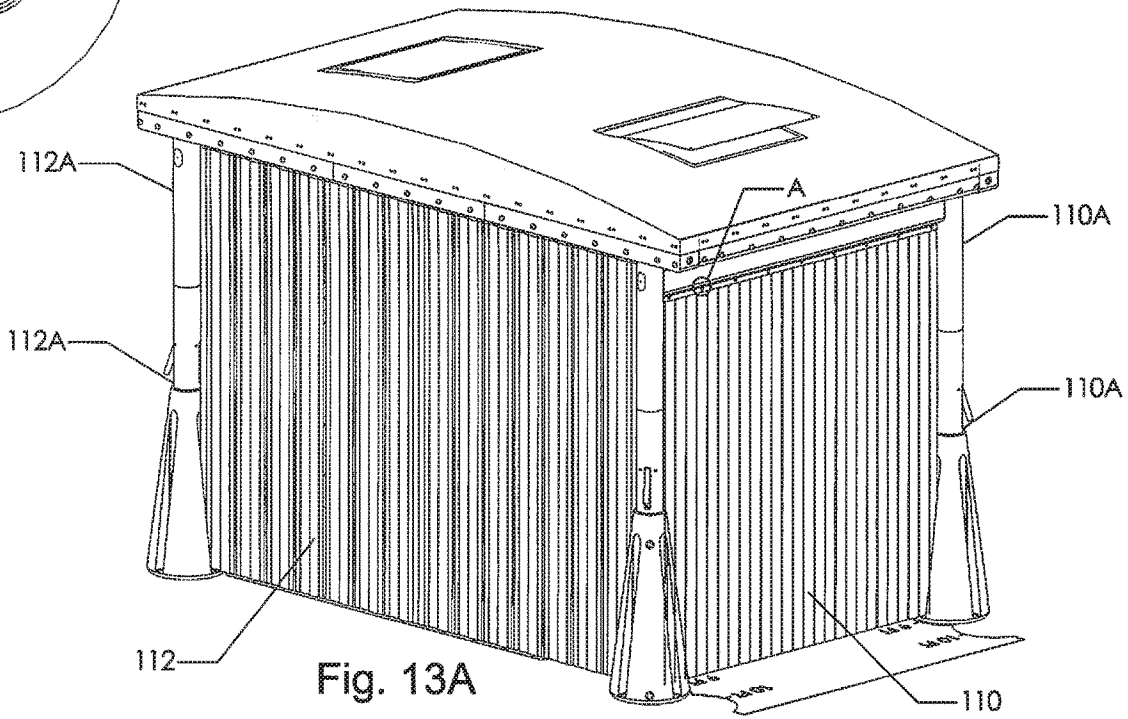
FIG. 13A is a perspective view of an assembled portable structure with curtains, according to one embodiment.
Figure 13C:
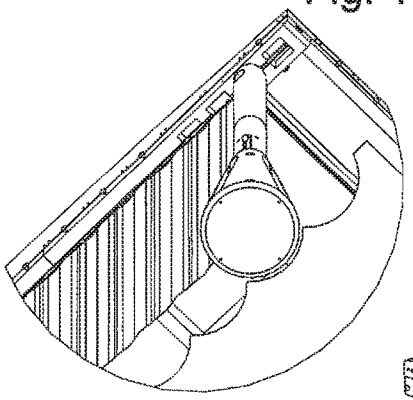
FIG. 13C is a bottom perspective view of a portion of the portable structure with curtains of FIG. 13A.

FIG. 13A shows a fully-assembled portable structure 1 with curtains attached thereto for additional shelter. For example, the ends of the structure 1 can each be equipped with an end curtain 110. The end curtain 110 is connected to the column beam 60 via the grooves on the bottom of the column beam 60. For example, as shown in FIG. 13B, the end curtain 110 is attached to the column beam 60 by hooks 115 that are slideable within the groove 64A of the column beam 60. This allows the end curtain 110 to be slid open and shut. End curtain holders 110A can be placed at various heights along each leg to assure the ends of the end curtains 110 remain attached or at least near the leg.

Similarly, side curtains 112 are provided that can be attachable to the truss assembly 68 via hooks within the grooves 76, 86. Side curtain holders 112A are also provided to attach the ends of the side curtains 112 to the legs, in similar fashion as the end curtain holders 110.

Figures 14, 15A, 15B, 15C, 16A, 16B:
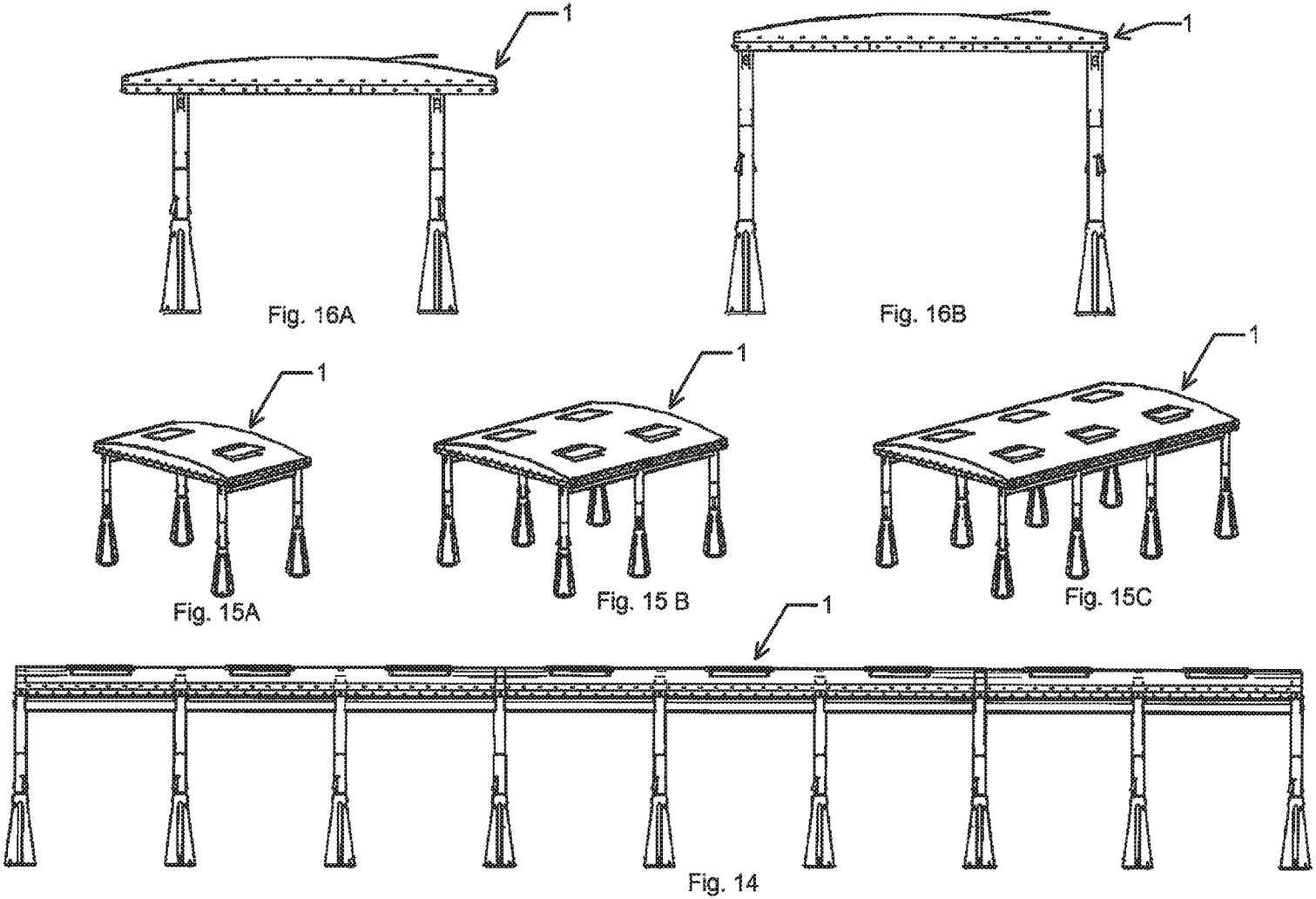
FIG. 14 is a side view of multiple portable structures assembled end-to-end to create a lengthy single portable structure, according to one embodiment.
FIGS. 15A, 15B, and 15C show perspective views of portable structures with various lengths, according to various embodiments.
FIGS. 16A and 16B show side views of various sized portable structures, showing the adjustability in height and width of the columns of the portable structure.

The present disclosure is not limited to only four legs with a single roof. For example, FIG. 14 illustrates an embodiment in which eight portable structures 1 are attached side-by-side along each structure's length. With the width of each structure being aligned side-by-side, the new "width" of the overall structure is eight times as wide as a single structure. In this embodiment, eight separate roof covers can be provided, but only 18 legs; each of the roof covers 100, except the covers at the end, can be attached to an anchor 73 of adjacent truss assembly 68 via the cords. This enables a cord from one roof cover 100 to interlock with anchors of a truss assembly 68, interlocking the structures into a single structure.

The size of each individual portable structure is not intended to be limited to the embodiment of FIG. 1. For example, FIGS. 15A, 15B, and 15C show various sizes of portable structures with varying number of legs. For example, FIG. 15A shows a single portable structure similar to that shown in FIG. 1. FIG. 15B shows an additional module placed side-by-side along the length of the structures. This is done by adding more column beams 60, truss assemblies 68, and legs. In some embodiments, such as the embodiment in FIGS. 15A-15C, a single roof cover 100 can be provided over more than four legs.

FIGS. 16A and 16B are provided to illustrate the customization of the portable structures 1. The portable structures can individually vary in length and height. To modulate the length of the portable structure 1, the end truss bodies 80 are provided with a plurality of receptacles 85A-85D to receive the upper column 50, as illustrated in FIG. 7B. To modulate the height of the portable structure 1, the lower columns 40 can be adjusted in height relative to the attachment rod 20 by screwing one direction or the other, for example, as illustrated in FIGS. 3C and 3F.

The portable structure disclosed herein can be used to shelter vehicles ranging from motorcycles, bikes, ATVs, to cars, vans, trucks, and boats. Since the user is able to fill the legs with a substance for added weight, the structure can provide a long-lasting, reliable, wind-resistant, seasonal or semi-permanent structure for sheltering objects.

While exemplary embodiments are described above, it is not intended that these embodiments describe all possible forms encompassed by the claims. The words used in the specification are words of description rather than limitation, and it is understood that various changes can be made without departing from the spirit and scope of the disclosure. As previously described, the features of various embodiments can be combined to form further embodiments of the invention that may not be explicitly described or illustrated. While various embodiments could have been described as providing advantages or being preferred over other embodiments or prior art implementations with respect to one or more desired characteristics, those of ordinary skill in the art recognize that one or more features or characteristics can be compromised to achieve desired overall system attributes, which depend on the specific application and implementation. These attributes can include, but are not limited to cost, strength, durability, life cycle cost, marketability, appearance, packaging, size, serviceability, weight, manufacturability, ease of assembly, etc. As such, to the extent any embodiments are described as less desirable than other embodiments or prior art implementations with respect to one or more characteristics, these embodiments are not outside the scope of the disclosure and can be desirable for particular applications.

What is claimed is:

1. A portable and adjustable shelter, comprising:

a plurality of legs, each leg having a column base defining a lower surface for contacting an underlying surface, and an upper surface defining a cavity with a first surface feature therein, a first column having a second surface feature configured to engage with the first surface feature within the cavity, wherein the second surface feature is adjustable relative to the first surface feature enabling the first column to be vertically adjusted relative to the column base, and a second column configured to attach coaxially with the first column, the second column having a projection extending therefrom; and a roof attached to the plurality of legs, the roof having a pair of truss assemblies configured to connect two of the legs, each truss assembly having an upper surface and a lower surface, the lower surface of each truss assembly defining a plurality of spaced apart receptacles sized to receive the projection of the second column to secure the roof to the legs at various positions.

2. The portable and adjustable shelter of claim 1, wherein the column base includes an inner surface and an attachment rod selectively disposed therein, the attachment rod defining the first surface feature.

3. The portable and adjustable shelter of claim 1, wherein the first and second surface features are screw threads allowing the first column to be vertically adjusted relative to the column base to alter a height of the legs.

4. The portable and adjustable shelter of claim 1, wherein the column base defines an exterior surface, an interior surface, a hollow cavity, and an aperture extending through the exterior surface and interior surface to provide access to the hollow cavity for filling with a substance to increase weight of the leg.

5. The portable and adjustable shelter of claim 1, wherein the first column has an exterior surface that defines a pocket, and wherein the first column includes a handle sized to nest within the pocket and rotatably attached to the first column to facilitate vertical adjustment of the first column relative to the column base.

6. The portable and adjustable shelter of claim 1, wherein each truss assembly includes a middle truss body and a pair of end truss bodies attached on either side of the middle truss body.

7. The portable and adjustable shelter of claim 6, wherein the end truss bodies each include an inner end attachable to the middle truss body and an opposing outer end, the inner end defining a slot ending in a receptacle, and wherein the middle truss body includes a projection sized to be received within the slot and a projection sized to be received within the receptacle to interlock the middle truss body with the end truss bodies.

8. The portable and adjustable shelter of claim 1, further comprising a plurality of beam members spanning across and connecting the truss assemblies, wherein each truss assembly includes a plurality of notches extending from an upper surface and partially toward a lower surface thereof to receive the beam members.

9. The portable and adjustable shelter of claim 1, wherein an outer surface of each truss assembly defines a plurality of apertures formed therein and aligned along a line, wherein the portable and adjustable shelter further comprises a plurality of anchors affixed within the apertures.

10. The portable and adjustable shelter of claim 9, wherein each anchor includes an attachment portion sized to be received within one of the apertures, a boss extending from the attachment portion having a diameter exceeding a diameter of the one of the apertures, and a flange extending from the boss, wherein the flange is spaced from the truss assembly when the attachment portion is attached to the truss assembly in the one of the apertures.

11. The portable and adjustable shelter of claim 10, further comprising a fabric spanning over the truss assemblies and coupled to each anchor about at least a portion of the boss.

12. The portable and adjustable shelter of claim 1, wherein the column base, the first column, the second column, and the truss assemblies are made of plastic.

13. A portable and adjustable shelter, comprising:

a plurality of legs adjustable in height, a portion of the legs defining a hollow cavity covered by a plug to enable storage of a substance therein to add weight to the legs, the legs each having a projection at one end;

a pair of truss assemblies, each truss assembly connecting two of the legs along a length of the shelter, each truss assembly having a plurality of receptacles facing the legs and configured to receive the projection enabling the legs to connect to the truss assemblies at various distances apart, the truss assemblies having a plurality of notches formed therein;

a plurality of beam body members, each beam body member connecting to both truss assemblies within two of the notches; and a fabric covering the beam body members and at least a portion of the truss assemblies.

14. The portable and adjustable shelter of claim 13, further comprising a plurality of anchors attached to the truss assemblies and defining an attachment surface for securing the fabric.

15. The portable and adjustable shelter of claim 14, further comprising a cord connecting the fabric to one or more of the anchors.

16. The portable and adjustable shelter of claim 13, wherein the fabric defines a vent hole and the portable and adjustable shelter further includes a vent cover covering the vent hole.

17. The portable and adjustable shelter of claim 16, wherein the vent cover is directly affixed to the fabric at a first end thereof, and is indirectly affixed to the fabric at a second end thereof via cords to allow the vent cover to open and close at the second end.

18. The portable and adjustable shelter of claim 13, further comprising a pair of column beams attaching two of the legs along a width of the shelter, the column beams having projections that are received within apertures in the legs.

19. The portable and adjustable shelter of claim 18, wherein the column beams each include a groove formed therein along a length of the column beam, the portable and adjustable shelter further including one or more curtains attached within the grooves of the column beams.

20. The portable and adjustable shelter of claim 13, further comprising a placement pattern configured to be placed on an underlying surface, the placement pattern having a plurality of cut-outs along a length thereof, each cut-out aligned with one of the receptacles of one of the truss assemblies when the placement pattern is on the underlying surface to provide a user with a template for locating the legs at various distances from one another.

* * * * *